United States Patent [19]

Juhász

[11] Patent Number: 4,665,894

[45] Date of Patent: May 19, 1987

[54] GAS-HEATED OR KEROSENE-HEATED BOILER FOR WARM WATER, HOT WATER OR STEAM GENERATION

[75] Inventor: Mihály Juhász, Érdliget, Hungary

[73] Assignee: Központi Váltó-es Hitelbank Rt. Innovációs Alap, Budapest, Hungary

[21] Appl. No.: 576,400

[22] PCT Filed: May 3, 1983

[86] PCT No.: PCT/HU83/00019

§ 371 Date: Jan. 17, 1984

§ 102(e) Date: Jan. 17, 1984

[87] PCT Pub. No.: WO83/04087

PCT Pub. Date: Nov. 24, 1983

[30] Foreign Application Priority Data

May 18, 1982 [HU] Hungary ..... 1567/82

[51] Int. Cl.[4] ..... F24H 1/00

[52] U.S. Cl. ..... 126/350 R; 122/250 R; 122/247; 122/182 R; 122/283

[58] Field of Search ..... 126/99 A, 350 R; 431/215; 122/244, 245, 247, 248, 250 R, 249, 182 R, 182 T, 182 S, 183, 184; 165/DIG. 2, DIG. 12

[56] References Cited

U.S. PATENT DOCUMENTS

| | | | |
|---|---|---|---|
| 273,433 | 3/1883 | Babbilt | 122/249 |
| 372,346 | 11/1887 | Walters | 122/244 |
| 373,576 | 11/1887 | Young | 122/283 |
| 1,631,699 | 6/1927 | Selmer | 122/247 |
| 1,674,295 | 6/1928 | Perass | 122/248 |
| 2,544,384 | 3/1951 | Henkel | 122/250 R |
| 2,552,044 | 5/1951 | Huet | 122/182 R |
| 2,554,631 | 5/1951 | Nehrbas | 122/250 R |
| 3,651,790 | 3/1972 | Barrault et al. | 122/182 R |
| 4,044,727 | 8/1977 | Rychen et al. | 122/249 |
| 4,291,649 | 9/1981 | Boder | 122/182 R |
| 4,294,199 | 10/1981 | Darling et al. | 122/249 |
| 4,357,910 | 11/1982 | Blockley et al. | 122/248 |
| 4,409,926 | 10/1983 | Moore | 122/182 R |

FOREIGN PATENT DOCUMENTS

| | | | |
|---|---|---|---|
| 3002561 | 6/1981 | Fed. Rep. of Germany | 122/182 R |
| B212066 | 1/1983 | Fed. Rep. of Germany | 126/378 |
| 7327 | 5/1916 | United Kingdom | 122/250 R |
| 449440 | 6/1936 | United Kingdom | 122/250 R |

*Primary Examiner*—Samuel Scott
*Assistant Examiner*—H. A. Odar

[57] ABSTRACT

The invention relates to a gas-heated or kerosene-heated boiler for warm water, hot water or for steam generation having a substantially horizontal cylindrical combustion chamber defined and surrounded by a flue tube (1) consisting of a plurality of annular ring tubes (b 2) that are arranged in succession for conveying a suitable heat carrier and are held together by means of annular distance strips (3). At least some of the annular ring tubes have different inner cross sections and/or are arranged in a manner of having different, unequal spacing distances one to the next. Thus, a substantially uniform main diameter of the flue tube (1) is maintained, and despite of this, the flow of heat carrier circulated is harmonized with the thermal load which is non-equally distributed along the axis of the combustion chamber, resulting in improved utilization of the heat energy radiation at substantially constant wall temperature along the flue tube (1).

4 Claims, 5 Drawing Figures

GAS-HEATED OR KEROSENE-HEATED BOILER FOR WARM WATER, HOT WATER OR STEAM GENERATION

TECHNICAL FIELD OF THE INVENTION

The present invention relates to a gas-heated or kerosene-heated boiler for warm water, hot water or for steam generation capable of meeting—when designed and constructed in different sizes—heat demand in all fields of application, i.e. heat demand of households and also such of public and indutrial use.

More particularly, the invention relates to a boiler having a substantially horizontal cylindrical combustion chamber defined and surrounded by a flue tube consisting of a plurality of annular ring tubes that are arranged in succession for conveying any suitable heat carrier, preferably water, said annular ring tubes being held together by means of annular distance strips. Each of the ring tubes is connected both to a distribution chamber that is situated beneath the combustion chamber, and to a collecting chamber which is arranged above the horizontal combustion chamber. At the front end of the combustion chamber a known firing device, i.e. a gas-burner or a kerosene-burner may be arranged, said burner having a flame the axis of which is substantially aligned with the axis of the cylindrical combustion chamber.

BACKGROUND ART

For the purpose as mentioned above, two basic types of boiler structures have been widely used. The first of said basic types is often referred to as horizontal drum boiler system. The capacity range of such horizontal drum boilers is substantially limited by the mechanical stength characteristics. For high capacity boilers are hence boilers of the second basic type, referred to as "stud-tube wall boiler" more frequently in use.

Known horizontal drum boilers have drawbacks which in most cases outweigh the advantages. Their main mechanical and calorific disadvantages may be listed as follows:

The water space is surrounded by a double shell of substantially large dimensions, said double shell consisting of cylindrical shell rings, of dished end plates and of substantially planar discs as wall partitions.

Increasing internal overpressure and increased power capacity may only be met and maintained by using substantially thick walls. It is well known that the wall thickness needed increases linearly with internal pressure and diameter in case of cylindrical shell rings, while there is a more progressive increase in case of planar wall partitions, whereby the possibilities of the increase of power capacity are limited.

Increased wall thickness means a smaller heat transfer coefficient. Hence, the surface temperature of the heated wall surfaces will be substantially higher.

Decrease in heat transfer characteristics and increased surface temperature result in loss of life.

There is an unequal and unstable thermal load distribution on the combustion chamber surface along the axis of the jet of flame, whereby certain surface areas are overheated while others remain below optimal thermal load.

Due to the above mentioned high wall thickness, specific structure material consumption rated to boiler capacity is relatively high and thus, the utilization of material is far below optimum values that involves high investment costs and also drawbacks of technological character.

Circulation of the heat carrier is not harmonised with thermal load. There is a stratified flow of flue gas leaving the combustion chamber and entering the convective heater. Hence, the temperature of the flue gas is in certain areas of the equipment higher than permissible while in other areas said temperature lies below the allowable values which results in higher calorific losses and in increased corrosion respectively.

Drawbacks in mechanical strength emerge from the structure itself. The firing fundamentals such as the unequal thermal load of the combustion chamber are partly a consequence of the furnace installation characteristics. However, they are also dependent from the type of burner applied. Similar relations exist concerning heat dissipation too.

Improved measuring techniques developed in the past few years only, have revealed access to a more accurate determination of the energy distribution of heat radiation within the combustion chamber. As a consequence, the unequal thermal load of the heated surfaces could not be measured earlier. This is why with boilers of conventional structure a proper utilization of the heat radiation energy has not been treated with sufficient care and hence, its problem has not yet been solved in known boilers of the type in question. The now wide-spread applications of measuring methods and isntruments working in the infrared range of radiation has opened the way to a deeper analysis of heat distribution within the combustion chamber and to an industrial utilization of the results learned.

It has been discovered that boiler structures showing both optimal firing and calorific data can only be designed by applying a combustion chamber having changing, varying, non-uniform circular cross section around the axis of the jet of flame. The diameter of the cross section should harmonize with the change of the heat radiation along the flame axis. Based on the above principle, boilers having really optimal calorific and life charateristics have been designed. Experience has shown however, that drawbacks arise with the above new structures in the field of manufacture. While with these boilers, due to their varying, non-uniform cross section a substantially equal thermal load of all heated surfaces has been achieved, manufacturers applying conventional technology, equipment and tools of manufacture heavily complain that a change and a renewal of their whole technology and equipment would be far too complicated and expensive.

An object of the present invention is to provide a horizontal drum-type boiler with at least equally optimal firing and calorific characteristics as newly developed known boilers having non-uniform combustion chamber cross section show and which, at the same time, are free of the above mentioned drawbacks of said known structures.

Another more specific object of the present invention is to provide a new improved boiler structure of the horizontal drum type which has a uniform circular cross section of the combustion chamber while still a substantially equal specific thermal load of the heated surface along the axis of the jet of flame is achieved and maintained.

DISCLOSURE OF THE INVENTION

The above and other objects have been fully achieved according to the present invention by providing a new improved gas-heated or kerosene-heated boiler for warm water, hot water or steam generation having a substantially horizontal cylindrical combustion chamber defined and surrounded by a flue tube consisting of a plurality of annular ring tubes that are arranged in succession for conveying any suitable heat carrier, preferably water, said annular ring tubes being held together by means of annular distance strips and each of said ring tubes being connected both to a distribution chamber that is situated beneath said combustion chamber and to a collecting chamber arranged above said combustion chamber, wherein the improvement consists in at least some of said annular ring tubes having different inner cross sections and/or being arranged successively in a manner of having different, unequal spacing distances one to the next along the axis of said cylindrical combustion chamber.

It has been found to be of advantage if said inner cross sections of and/or spacing distances between the annular ring tubes forming a substantially cylindrical flue tube around the combustion chamber are in their dimensions linearly changing with the effective values of the heat radiation or of the density of heat flux along the axis of the combustion chamber, said axis being substantially aligned with that of the jet of flame of the gas burner or kerosene burner applied.

Since both, operational safety and reliability of service together with long service life require that none of the built-in heated surfaces should be either overheated or underheated, instead of a combustion chamber of non-uniform cylindrical cross section a substantially cylindrical flue tube consisting of annular ring tubes of at least partially non-uniform inner cross section for heat carrier circulation and of annular distance strips of at least partially non-uniform width therebetween has been provided. Thus, the flow of heat carrier circulated is harmonized with the thermal load that is non-equally distributed along the axis of the combustion chamber, i.e. along that of the jet of flame. In areas of higher thermal load are ring tubes of increased inner cross section, i.e. of increased flow diameter for the heat carrier provided with smaller distance strips between. Thus, the mean cylinder diameter of the flue tube forming the combustion chamber could be kept at a constant value, while in areas of intensive heat transfer simultaneously an equally intensive heat transport by increased circulation is provided for.

The boiler according to the invention is easy to manufacture, drawbacks of that kind associated with known prior art structures are fully eliminated. Another favourable feature of the boiler in question is that all its component parts carrying overpressure are tubes. The advantage lies in that to withstand overpressures which are allowable in practice, tubes having relatively small wall thickness are sufficient. Power capacity can be increased, since it involves a very slight increase of tube wall thickness only. A flue tube consisting of thin-wall annular ring tubes held together by welded annular strips inbetween, provides a very intensive improved heat transfer. There is an equal temperature of all heated surfaces provided for, which only slightly exceeds that of the heat carrier. This results in higher operational safety and in increased service life. Also, specific structure material consumption, gravity and size of the boiler according to the invention rated to its power capacity are very favourable.

As already mentioned earlier, experience with known boilers of the horizontal drum type has shown that flue gases of different temperature have a stratified flow pattern consisting of parallel layers one above the other that do not tend to mixing with each other. This may result in drawbacks like causing early corrosion, etc. According to the present invention it is proposed to arrange a contraction member at the rear end of the combustion chamber, preferably by applying a last ring tube of flattened oval cross section in the flue tube forming the combustion chamber, that is followed by a turning chamber of substantially U-shaped cross section for diverting the flow of the flue gas at an angle of around 90° with respect of the horizontal axis of the combustion chamber. As a result, the flue gas flow passes through a convective heater which is arranged in the path thereof after having been diverted or turned at around a right angle. The stratified flow pattern of the flue gas is thereby forced to be substantially mixed. Thus, the convective heater is fed by a flow of flue gas that is free of remarkable differences in temperature and has a nearly evenly distributed heat content. When properly adjusted burner is applied, the flue gases leaving the convective heater have a temperature that is above dew point and lies around the value allowed. These are fundamental conditions both for minimum tendency to corrosion and for high thermal efficiency.

The above requirements are also largely dependent from the temperature of the heat carrier on one hand, and from that of the surfaces arranged in the path of the flue gas on the other. Therefore, in embodiments of the boiler according to the present invention in which warm water or hot water is generated by a heat carrier having temperatures below 100° C. in the return duct, there is provided a turning chamber of a substantially U-shaped cross section which is open at its top section. In addition to this, the convective heater is arranged in the path of the flue gas flow in a way that it is situated between cross flow chambers connected first in series with water tubes of the convective heater and then, connected to the collecting chamber. In that manner, the flue gases do not pass surfaces of significantly lower temperature, whereby the possibility of reaching the dew point and as a result, a tendency to cause corrosion are largely eliminated.

Again in embodiments designed for hot water or steam generation wherein the temperature of the heat carrier measured in the return duct is above 100° C., according to the present invention a turning chamber having a U-shaped cross section which is open at its bottom section is provided for, and a convective heater is arranged in the path of the flue gas flow beneath of cross flow chambers that are connected to the distribution chamber below.

In preferred embodiments of the boiler according to the invention that are designed for steam generation with a heat carrier having temperatures above 120° C., measured in the return duct, the structure may be similar to that as described above. However, it has been found to be advantageous to arrange an additional feed water heater following the convective heater in the path of the flue gas flow, and said feed water heater should preferably be connected to the water space of a boiler drum.

BRIEF DESCRIPTION OF DRAWINGS

The invention will be more detailed and particularly described by introducing by way of example only, preferred embodiments of the new boiler structure with reference to the attached drawings in which.

MODES FOR CARRYING OUT THE INVENTION

Figure 1:
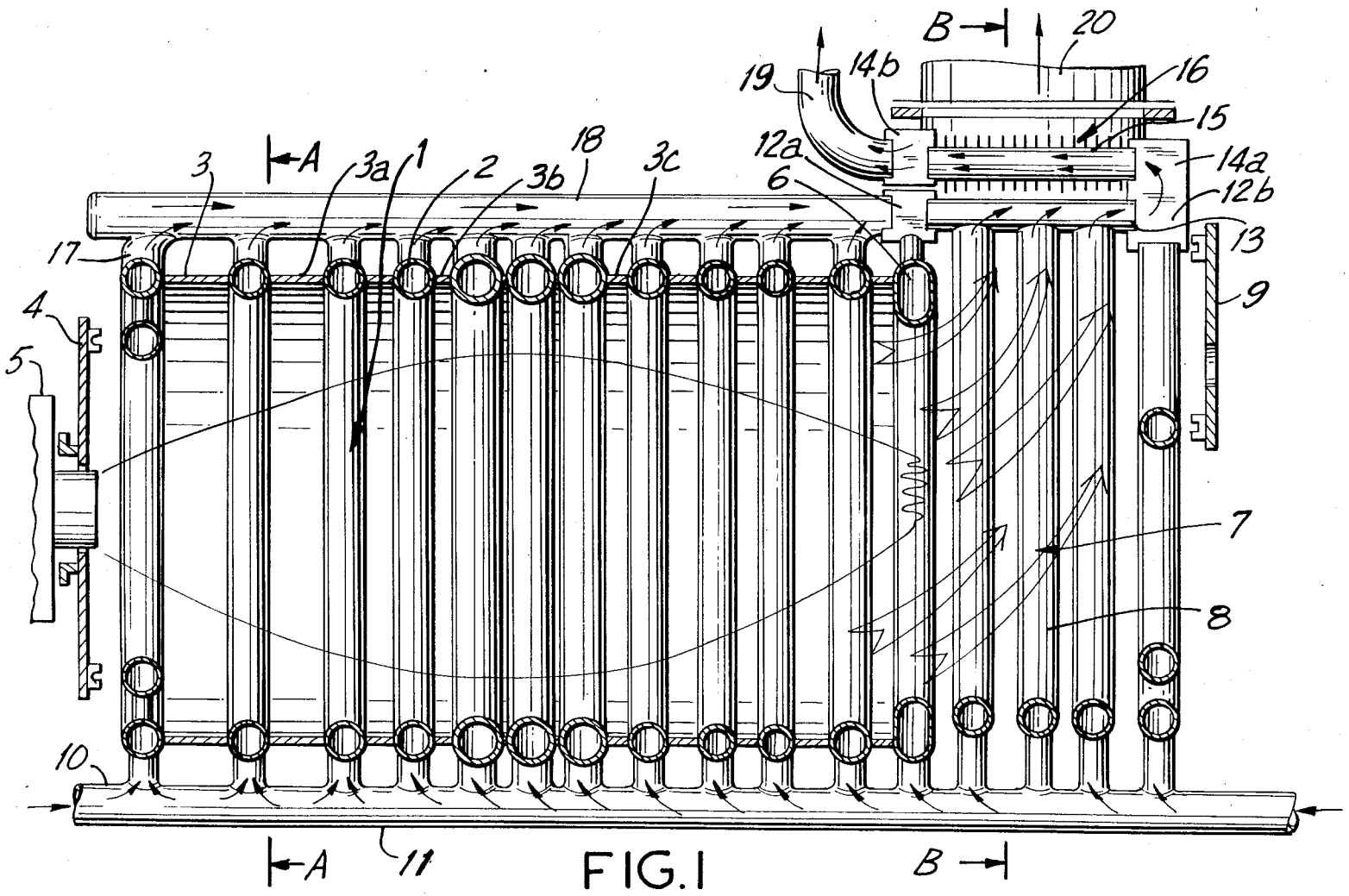
FIG. 1 shows a horizontal longitudinal sectional view of a boiler for warm water generation according to the invention.
Figure 3:
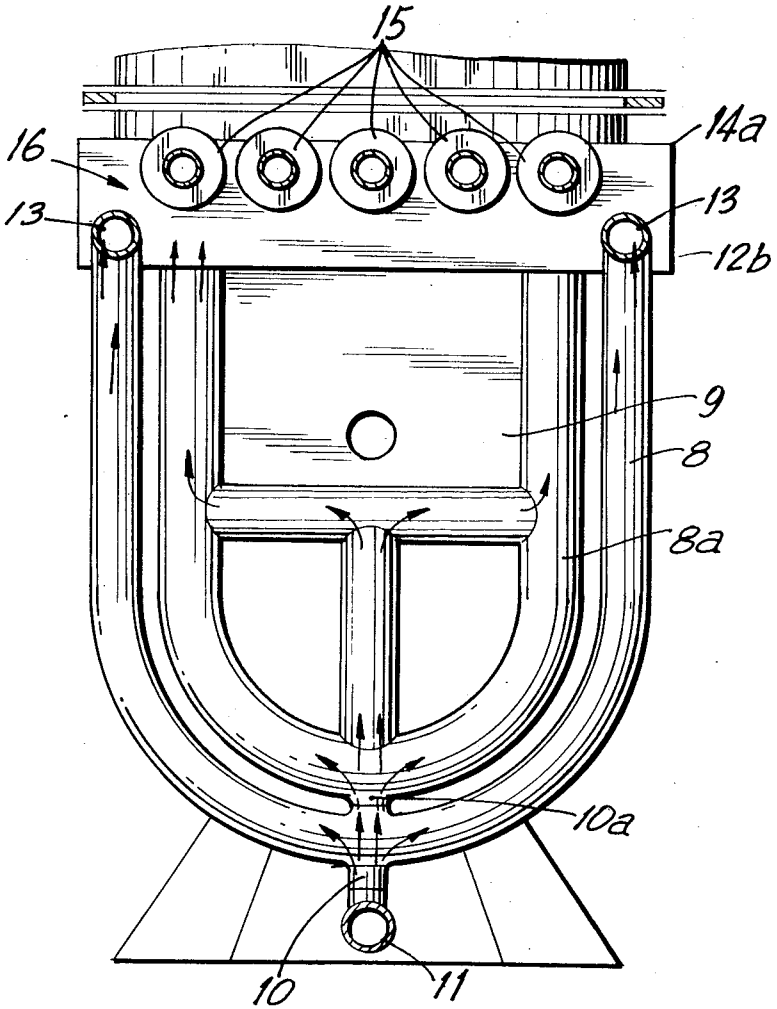
FIG. 3 is a sectional view of the same boiler, taken along line B—B as shown in FIG. 1.
Figure 2:
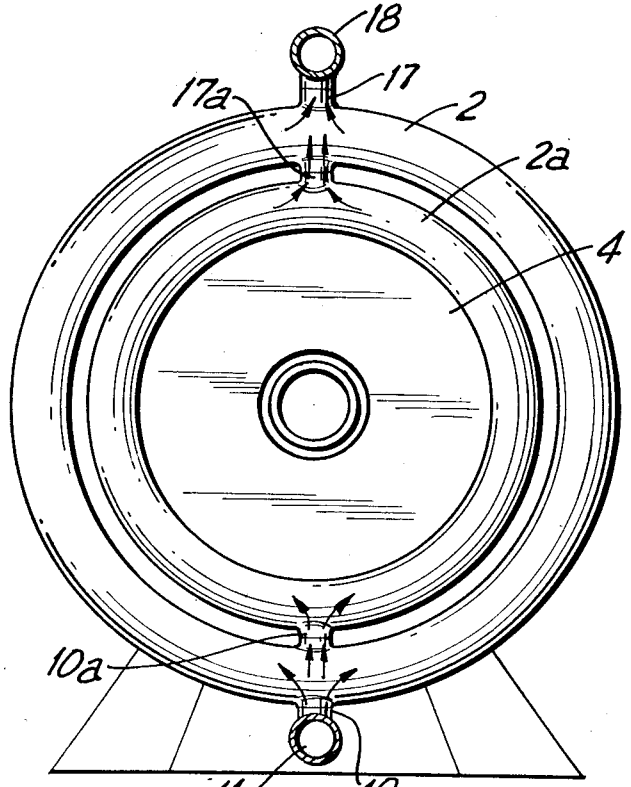
FIG. 2 is a sectional view taken along line A—A in FIG. 1 of the same boiler.

As shown in FIGS. 1 to 3, a preferred embodiment of the boiler for warm water generation has, according to the invention, a flue tube 1 around its horizontal, substantially cylindrical combustion chamber. Said flue tube 1 consists of a plurality of successively arranged annular ring tubes 2 that are held together by annular distance strips 3. The inner diameters and thus, the inner cross sections of the ring tubes 2 as well as the width of the annular distance strips 3, i.e. the spacing distances between juxtapositioned ring tubes 2 are—at least partially—different when measured along the axis of the flue tube 1. Said cross sections and/or spacing distances are varying in a manner that they depend from and duly harmonize with expected values of heat radiation and/or of the density of heat flux, both of them being variable along the axis of the jet of flame that is substantially aligned with that of the flue tube 1. The front end of the flue tube 1 is provided with a front door 4 which simultaneously forms a support for a gas operated or kerosene operated burner by having an annular flange 5 for that purpose. At the rear end of the flue tube 1 there is arranged a contraction member 6 that is preferably made of a ring tube by flattening so as to have a substantially oval cross-section. Quite obviously, contraction members 6 consisting of a plurality of ring tubes 2 having a with respect of that of the flue tube 1, i.e. of the ring tubes 2 reduced diameter, may also be applied with other embodiments. Contraction member 6 is then followed by a turning chamber 7 of substantially U-shaped cross section which serves as mixing chamber for the stratified flue gas flow by diverting its path of flow upwardly, around an angle of around 90° with respect to the horizontal axis of the flue tube 1. Turning chamber 7 consists of U-shaped water tubes 8 held together by plate strips. Its closed end facing the contraction member 6 is provided with a door 9 for cleaning and also for inspecting purposes, if necessary.

Ring tubes 2 of the flue tube are connected by means of pipe stubs 10 to a distribution chamber 11 arranged beneath the flue tube 1, and also by means of pipe stubs 17 to a collecting chamber 18 that is situated above the flue tube 1, respectively. Collecting chamber 18 is connected to a bottom section **12*a* of a front crossflow chamber 12, that consists of two sections one arranged above the other, said front crossflow chamber 12 being connected by means of horizontally arranged joint pipes 13 to a rear crossflow chamber 14 that also consists of two but interconnected sections. The ring tube(s) forming the contraction member 6 is (are) also connected to the bottom section 12*a* of crossflow chamber 12, while both upwardly extending legs of all but the last U-shaped water tubes 8 are connected to the joint pipes 13. The two legs of said last water tube 8 are directly connected to the bottom section 14*a* of the rear crossflow chamber 14. Upper sections 14*b* and 12*b* of crossflow chambers 14 and 12, respectively, are interconnected by flanged water tubes 15 the assembly of which provides a convective heater 16 for utilizing the rest of the heat carried by the leaving flue gas flow. Since the temperature of the heat carrier just coming from the collecting chamber 18 and flowing through pipes and ducts arranged in the convective heater 16 is near the highest temperature value measurable within the whole system, flue gases cannot cool down below dew point which would cause easy and rapid corrosion. Having water tubes 15 of larger diameter, especially with high capacity boilers, it has turned out to be advantageous to have them without flanges. Water already heated within the boiler is leaving the upper section 12*b* of the front crossflow chamber 12 via stub 19 for further utilization, while flue gases leave the system described after having passed the convective heater 16, through a flue stub 20**.

Figure 4:
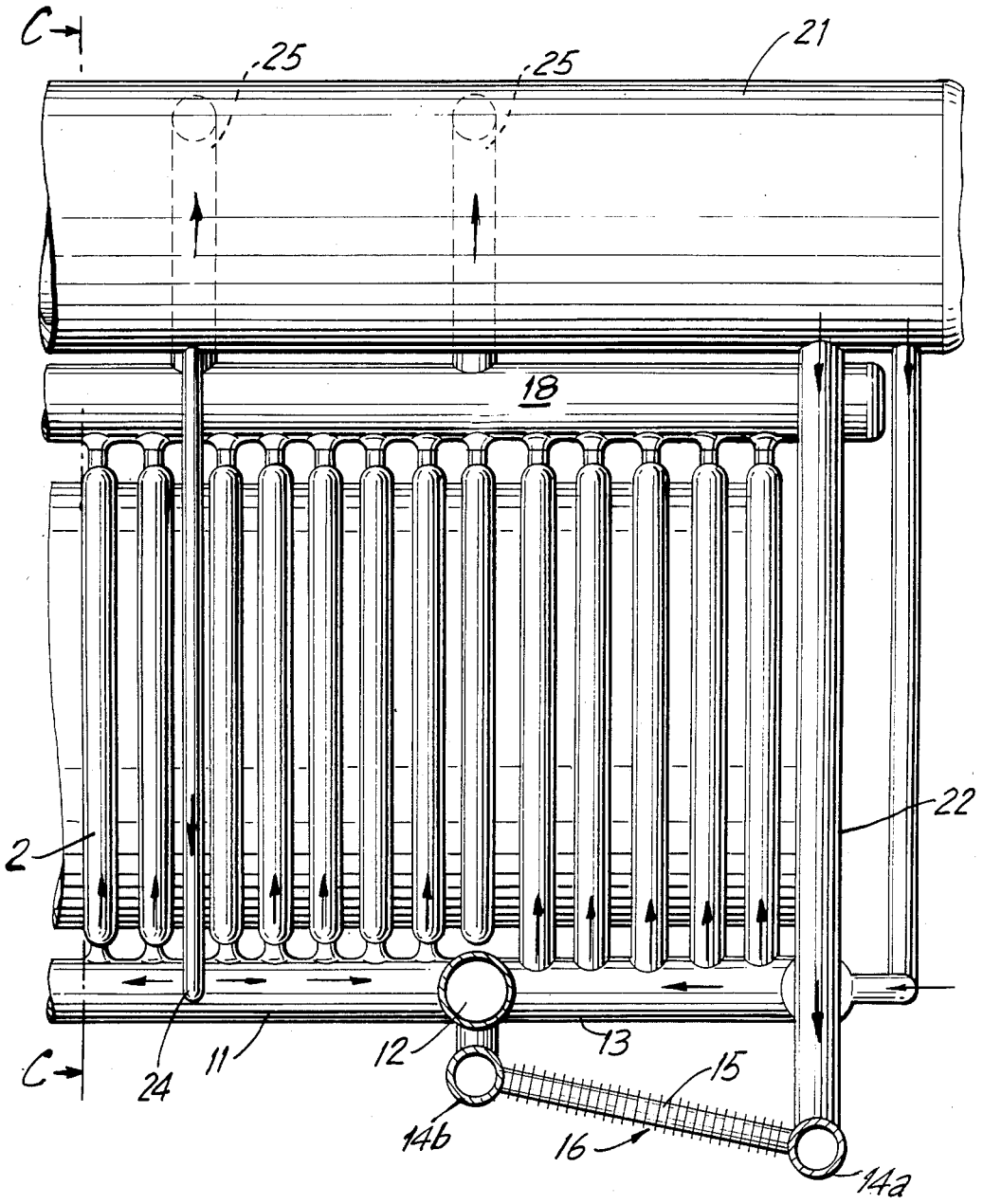
FIG. 4 shows a horizontal longitudinal sectional view of another preferred embodiment of a boiler according to the invention for steam generation.
Figure 5:
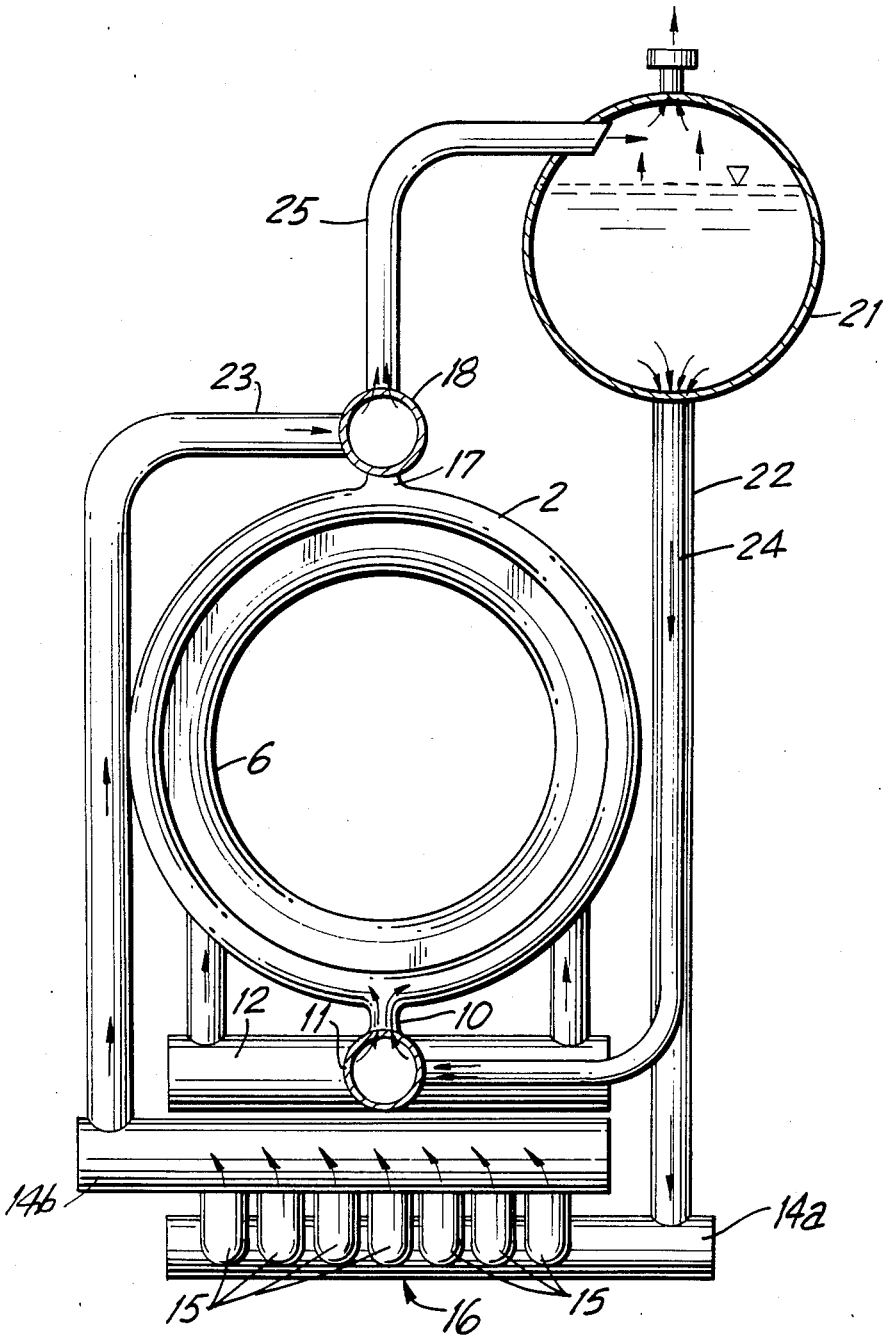
FIG. 5 is a sectional view of the same boiler for steam generation, taken along line C—C as shown in FIG. 4, showing also a boiler drum schematically.

FIGS. 4 and 5 show another preferred embodiment of the boiler according to the invention. This embodiment is designed and laid out especially for steam generation. However, its main structure is quite similar to that of the embodiment shown in and already described with reference to FIGS. 1 to 3 above. One of the differences lies in that the boiler for steam generation is equipped with a boiler drum 21. As a second difference, the turning chamber 7 of the latter is arranged in a manner that its U-shaped cross section is turned around 180° having thereby its open part at the bottom section. This is because with steam boilers, leaving flue gases are significantly hotter than those with boilers for warm water generation. Hence, they should be contacted with a heat carrier of lower temperature in order to achieve better efficiency and to minimize heat losses. Therefore, the front crossflow chamber 12 is connected to the distribution chamber 11 and thus crossflow chamber 14 together with both joint pipes 13 are positioned at the bottom. Crossflow chambers 12 and 14 are both one-section chambers only without being connected to the convective heater 16 that is arranged behind, better to say beneath them. The convective heater 16 is instead, via return ducts 22 and ongoing ducts 23 connected to the boiler drum 21, which in turn is in connection with the collecting chambers 18 through an ongoing duct 25 and with the distribution chamber 11 through a return duct 24. Being part of a steam boiler here, the convection heater 16 is arranged in a manner of having tubes lying inclined at an angle of at least 15° with respect of the (horizontal) axis of the flue tube 1.

In order to utilize the rest heat contents of the flue gas leaving, a feed water heater of similar structure to that of the convective heater 16 is placed beneath the latter. Water is introduced from a feed water reservoire (not shown) by means of a pump into said feed water heater. From here, preheated food water is led into the water space of the boiler drum 21 through a pipe having a perforated end connected to the bottom part boiler drum 21.

I claim:

1. A boiler comprising: an essentially cylindrical combustion chamber of circular cross section and having a longitudinal axis extending essentially horizontally; means for causing a jet flame to burn in and extend along said combustion chamber essentially along said longitudinal axis, said jet flame transferring heat therefrom with the amount of heat being transferred from said jet flame varying along essentially the entire longitudinal extent of said jet flame; said combustion chamber having an essentially cylindrical mantle composed of a plurality of pairs of individual, parallel semi-circular tubes arranged in substantially vertical planes and being spaced apart one behind the other in the direction of said longitudinal axis; each of said semi-circular tubes forming an individual flow path of predetermined cross section for a fluid to be heated mainly by heat radiation emitted from the jet flame; a distribution chamber arranged below said semi-circular tubes, and separate means connecting each individual tube to said distribution chamber for introducing the fluid to be heated thereinto; and a collecting chamber arranged above said semi-circular tubes, and separate means connecting each individual tube to said to said collecting chamber for collecting the heater fluid therefrom; the cross section of each individual tube and the spacing between adjacent tubes along the entire longitudinal extent of said jet flame varying to match the variation in the amount of heat being transferred from said jet flame along the longitudinal extent of said jet flame so that the location and size of each individual flow path along the entire longitudinal extent of said jet flame vary and are arranged so that areas of higher flame temperature have flow paths therearound which are larger than the cross section of the individual fluid flow paths of those semi-circular tubes which are arranged around longitudinal areas of lower flame temperature of said jet flame, and the spacing between adjacent flow paths is arranged to correspond to the variation of the flame temperature, whereby a non-equal, non-uniform fluid flow rate per axis length unit over the entire length of said jet flame axis is achieved in said mantle of said combustion chamber.

2. A boiler according to claim 1, wherein adjacent pairs of said semi-circular tubes are spaced from each other by annular distance strips.

3. A boiler according to claim 2, comprising a contraction member arranged at said combustion chamber opposite said jet flame causing means.

4. A boiler according to claim 1, comprising a contraction member arranged at said combustion chamber opposite said jet flame causing means.

* * * * *